US005520435A

United States Patent [19]

Fujimoto et al.

[11] Patent Number: 5,520,435

[45] Date of Patent: May 28, 1996

[54] RECLINING LEGLESS CHAIR WITH INTERLOCKING HEADREST

[75] Inventors: Shinichiro Fujimoto, Osaka; Yoshikiyo Yamasaki, Sakai; Masaki Wada, Osaka, all of Japan

[73] Assignees: Kabushiki Kaisha Fuji Iryoki, Osaka; Kabushiki Kaisha Japan Health, Sakai; Kabushiki Kaisha Techno Patent, Osaka, all of Japan

[21] Appl. No.: 141,814

[22] Filed: Oct. 22, 1993

[51] Int. Cl.[6] ..... A47C 1/036

[52] U.S. Cl. ..... 297/61; 297/408; 297/354.13

[58] Field of Search ..... 297/61, 408, 354.13, 297/354.12, 354.1, 361.1, 362, 391, 396, 452.58, 452.48, 352, 284.1, 284.3

[56] References Cited

U.S. PATENT DOCUMENTS

| | | | |
|---|---|---|---|
| 2,635,679 | 4/1953 | McDonald | 297/352 X |
| 2,843,183 | 7/1958 | Luckhardt | 297/61 |
| 3,416,839 | 12/1968 | Flint | 297/396 |
| 3,893,731 | 7/1975 | Maggs | 297/396 X |
| 4,109,960 | 8/1978 | Stinchfield | 297/258 |
| 4,208,070 | 6/1980 | Geschwender | 297/118 |
| 4,641,884 | 2/1987 | Miyashita et al. | 297/284.3 X |
| 4,699,422 | 10/1987 | Yamasaki | 297/18 |
| 4,818,018 | 4/1989 | Yamasaki | 297/284.1 |
| 4,830,429 | 5/1989 | Petitjean | 297/61 X |

FOREIGN PATENT DOCUMENTS

| | | | |
|---|---|---|---|
| 2952064 | 6/1981 | Germany | 297/61 |

*Primary Examiner*—Milton Nelson, Jr.
*Attorney, Agent, or Firm*—Flynn, Thiel, Boutell & Tanis

[57] ABSTRACT

A reclining legless chair comprising an interlocking headrest constructed from a framework composed of a seat frame, back materials, and a headrest frame, which allows users to automatically set the inclining angle of the headrest which is interlocked to the angle between the seat and the back of the chair wherein the latter angle can be set in one of several steps at will by a user. The framework is made from a U-shaped seat frame, back materials and a headrest frame, in which both opening ends of the seat frame are connected to the straight rods of the back materials through a ratchet and the other ends of the rods are connected to both ends of a U-shaped headrest frame through interlocking mechanisms. The framework is suitably covered with elastic materials, is finished by covering the elastic materials with external cloth and permits the headrest frame to move interlockingly with the inclining angle of the back materials against the seat frame.

4 Claims, 5 Drawing Sheets

RECLINING LEGLESS CHAIR WITH INTERLOCKING HEADREST

BACKGROUND OF THE INVENTION

1. Field of the Invention

This invention concerns a reclining legless chair with interlocking headrest composed of three parts; i.e., a seat frame, back materials and a headrest frame, where the angle of inclination of a back frame can be adjusted at will by a user in several steps and the inclined angle of the headrest can be automatically adjusted stepwise in relation to the angle of the back of the chair.

2. Description of the Prior Art

Legless chairs are generally used in a room with a cushion on the seat if the user wants and can be used by sitting on it and setting the back of the chair as the user chooses at any angle to make himself (or herself) feel comfortable or to sleep without falling down backwardly.

By the way, previously invented legless chairs were commonly built from a framework composed of two parts; i.e., a seat frame and back materials, which were connected through ratchet gearings between them to form the framework. This chair was completely covered with elastic materials like polyurethane and finished by covering them with external cloth. This type of chair generally has been widely used at home.

However, in these previously invented legless chairs, whose back was manually adjustable at a desired angle optionally by the adjustment of the ratchets connected to the seat, the headrest was kept at a constant angle relative to the back of the chair. Although the chair had merit in that it could be used at will by the user to provide a relaxant pose, it gave rise to the fault of making a user easily feel tired especially at the user's neck.

Therefore, in order to solve the above faults, a legless chair, whose framework was composed of three parts, i.e., a seat frame, back materials, and a headrest frame, in which the first two and the latter two were connected to each other through ratchets, was completely covered with elastic materials like polyurethane and was finished by covering them with external cloth, has been invented and sometimes used.

But in these legless chairs, because each of the angles of the back against the seat and of the headrest against the back was independently changeable by the ratchets connecting them, they had merit in that they could be used with two independent angles at will by the user to be as relaxant as possible in comparison with the previously invented older legless chairs. On the other hand, there arose new weaknesses in that the manufacturing cost of such a legless chair could be raised if the ratchet gearing was used in more than two places because a ratchet gearing is very expensive, and at the same time, adjustment of the angles at the ratchet gearings is troublesome because the angles at the ratchets supporting the headrest should be adjusted in addition to those supporting the back against the seat.

SUMMARY OF THE INVENTION

In manufacturing a reclining legless chair constructed from a framework composed of a seat frame, back materials, and a headrest frame, in which only the angle between the seat and the back was adjustable stepwise, this invention has solved the above mentioned faults of the previously invented chairs and has an object of presenting a cheaper stable reclining legless chair with an interlocking headrest, the angle of which is automatically selected in a stable state in relation to the angle of the seat against the back of the chair which is only adjustable manually to provide as much comfort as possible.

DETAILED DESCRIPTION OF THE INVENTION

The reclining legless chair with interlocking headrest of this invention has; a distinguishing feature in the interlocking mechanism so as to make the headrest move in relation to the inclination of the back materials against the seat frame of the chair. The chair is constructed from a framework, which framework is completely covered with elastic materials and finished by covering the elastic materials with external cloth. The framework is composed of a seat frame, back materials, and a headrest frame. Both ends of the U-shaped seat frame are each connected to a straight rod of the back materials through a ratchet and the other ends of the rods are connected to both ends of a U-shaped headrest, respectively, through the interlocking mechanism.

Further, this invention relates to the construction of the interlocking mechanism, which is formed by connecting each of the opening ends of the headrest frame to one end of the straight rod of the back materials through a hinged joint and by installing a connection rod between each inside of the hinged joints and each inside of the frame materials of the ratchets in a way which is a little eccentric from each of the pivots of their movable shafts.

The reclining legless chair with interlocking headrest of this invention may bring about actions as described below when it is constructed according to the above mentioned instruction.

Thus, it can achieve an interlocking movement of the slant of the headrest frame only by changing the angle of inclination of the back materials against the seat frame, because the total framework is constructed from a seat frame, back materials, and a headrest frame, in which the back materials are connected to the seat by way of ratchets at both sides thereof, and interlocking mechanisms are installed between the headrest and the back materials.

Further, the reclining legless chair with interlocking headrest of this invention is constructed so as to give an interlocking inclination of the headrest frame by installing only two ratchets at both sides of the U-shaped seat frame without using more than two ratchets, and therefore, is kept cheaper in the production costs.

Figure 6:
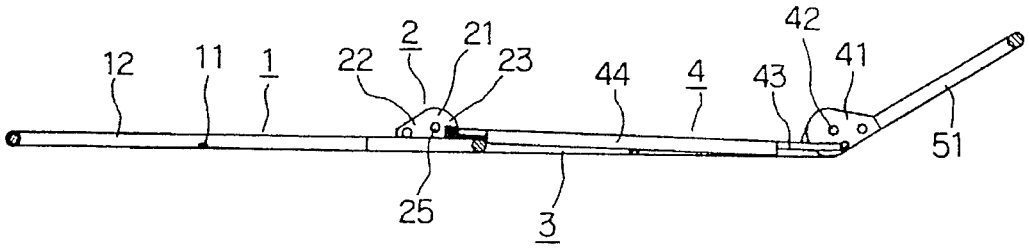
FIG. 6 is a side cross sectional view showing the first embodiment of the reclining legless chair with interlocking headrest of this invention under a stretching state of the framework.
Figure 7:
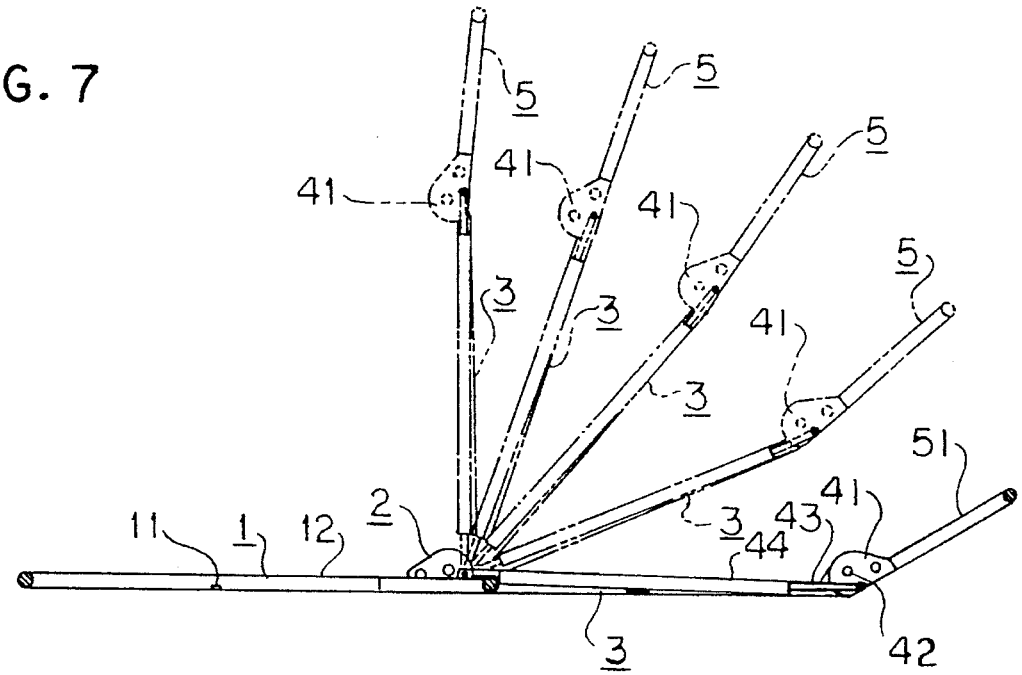
FIG. 7 is a side cross sectional view showing changes in the inclination of the back frame and of the headrest in the course of a stepwise variation of the angle between the back and the seat of a reclining legless chair with interlocking headrest of this invention.
Figure 8:
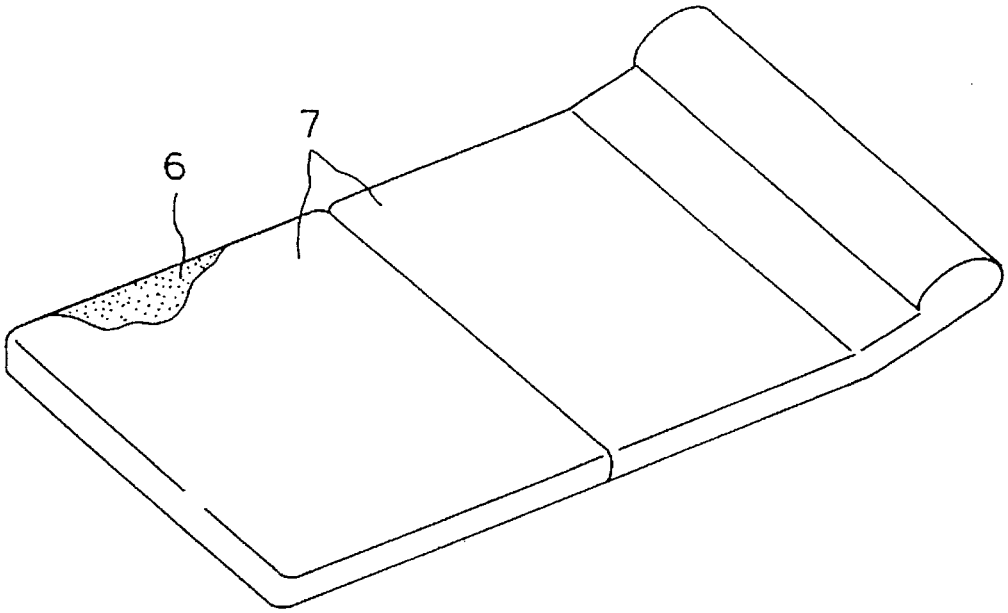
FIG. 8 is a pictorial view showing an embodiment of a framework in the reclining legless chair with interlocking headrest of this invention under a stretching state of the back of the chair.
Figure 9:
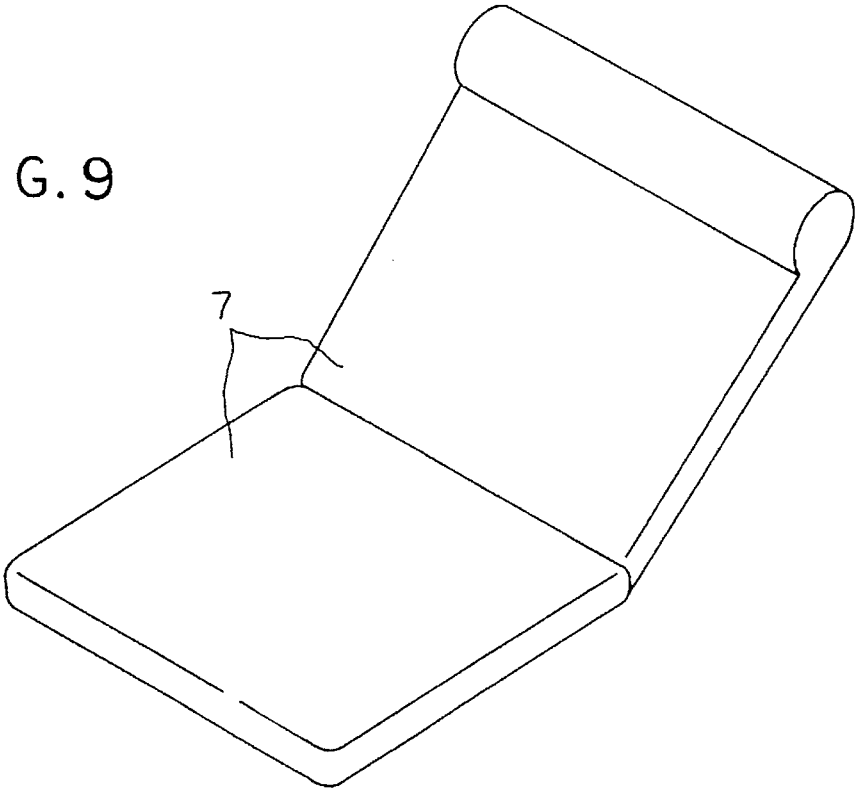
FIG. 9 is a pictorial view showing an embodiment of a framework in the reclining legless chair with interlocking headrest of this invention under a bending state of the back of the chair.
Figure 10:
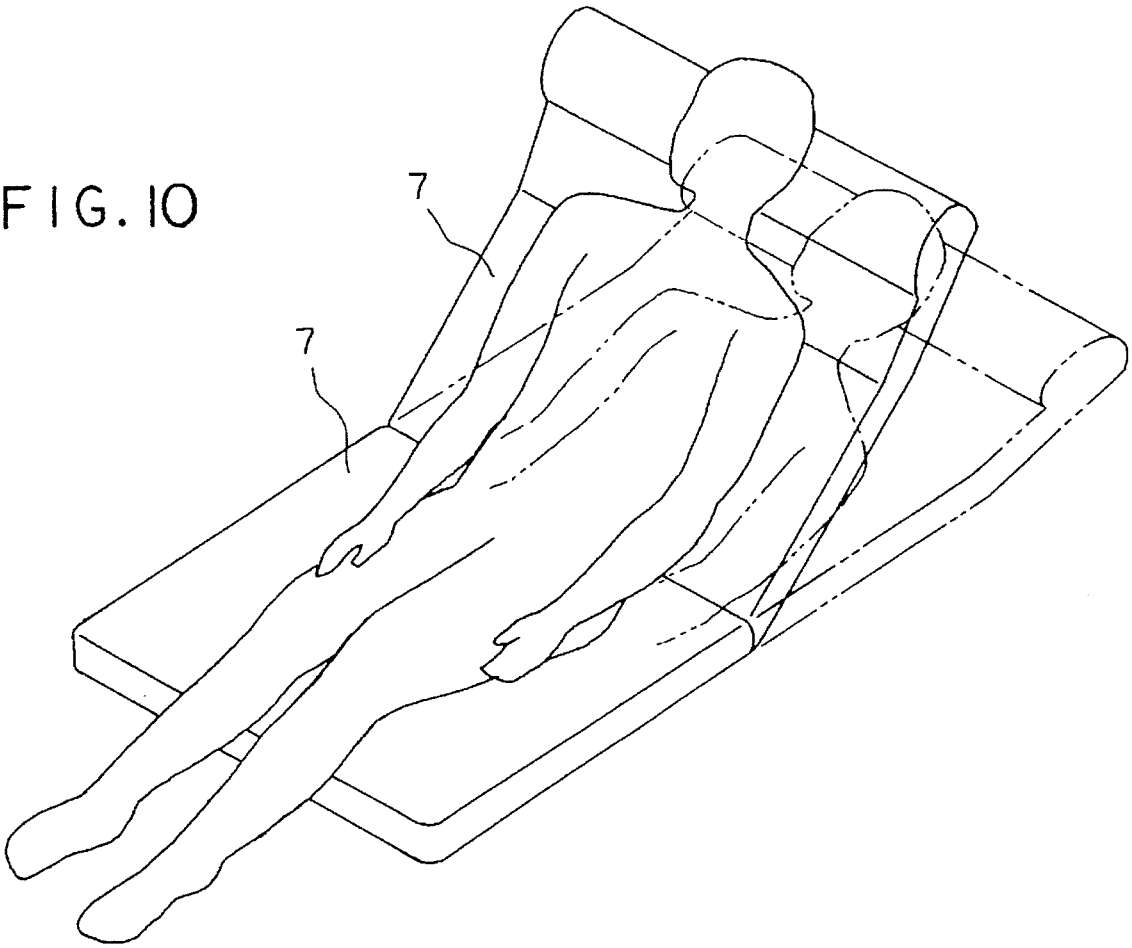
FIG. 10 is a pictorial view showing an embodiment of the reclining legless chair with interlocking headrest of this invention in use.

An example of the preferred embodiments of a framework of the reclining legless chair with interlocking headrest of this invention are shown in FIGS. 1–7. An example of the embodiment of a reclining legless chair in this invention finished with external cloth over the elastic materials which covers its framework is shown in FIG. 8–FIG. 10.

Thus, the reclining legless chair with interlocking headrest of this invention is produced by covering over the elastic material 6 with cloth 7. The elastic material 6 completely covers the framework, which framework is constructed as follows; both ends of a seat frame 1 are respectively connected through ratchets 2 to the straight rods of back materials 3 and further, these back materials 3 are interlocked to a headrest frame 5 through interlocking mechanisms 4.

The seat frame 1 is made from either a rod or a pipe made of metal, wood, or plastics and in the form of a U-shape, both ends of which are opened. A reinforcing rod 11 is fixed between the middle points of both linear parts of the seat frame 1. Each of the opposite ends 12 of the seat frame 1 are connected to the fixed ends 22 of a frame material 21 of the ratchet 2 which allows a suitable angle to be set in several steps.

The ratchet 2 is produced so as to be able to fix at will the angle at a movable shaft 24 of the round end 23 of the frame material 21. For example, by using such product, it is possible to vary and fix the angle at one of five steps as shown in FIG. 7 and by installing it in both ends of the seat frame 1, users can fix at will the angle of a pair of the back materials 3 to one of the five steps, which back materials 3 are connected to the movable shafts 24 of the round ends 23 of the ratchets The back materials 3 are made in a straight shape from either rod or pipe made of metal, wood, or plastics etc., and are interlocked to the movable shaft 24 of the round end 23 in each of the ratchets 2 which are fixed at both of the open ends of the seat frame 1.

Figure 1:
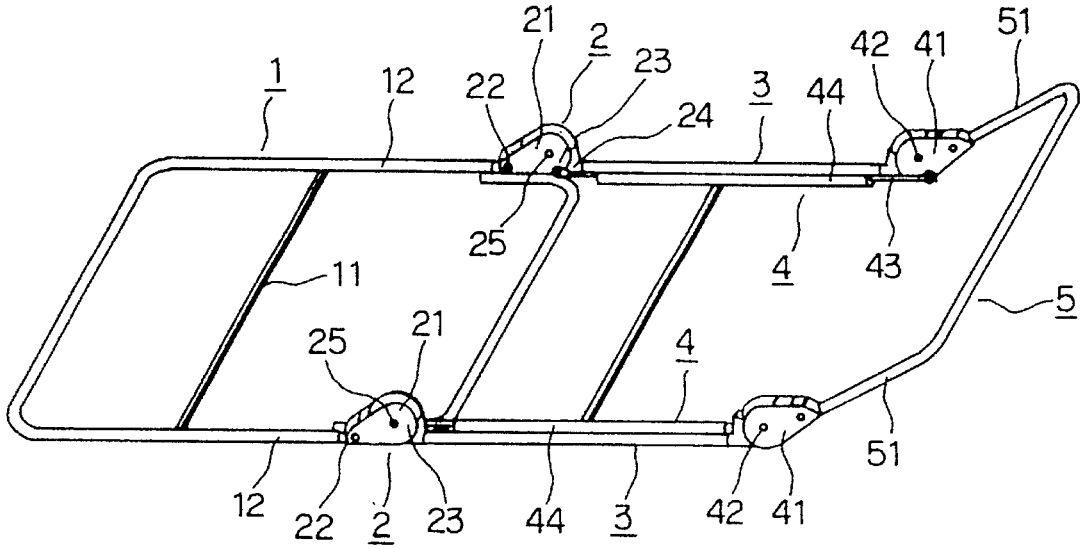
FIG. 1 is a side pictorial view showing a first embodiment of a framework of the reclining legless chair with interlocking headrest of this invention.
Figure 2:
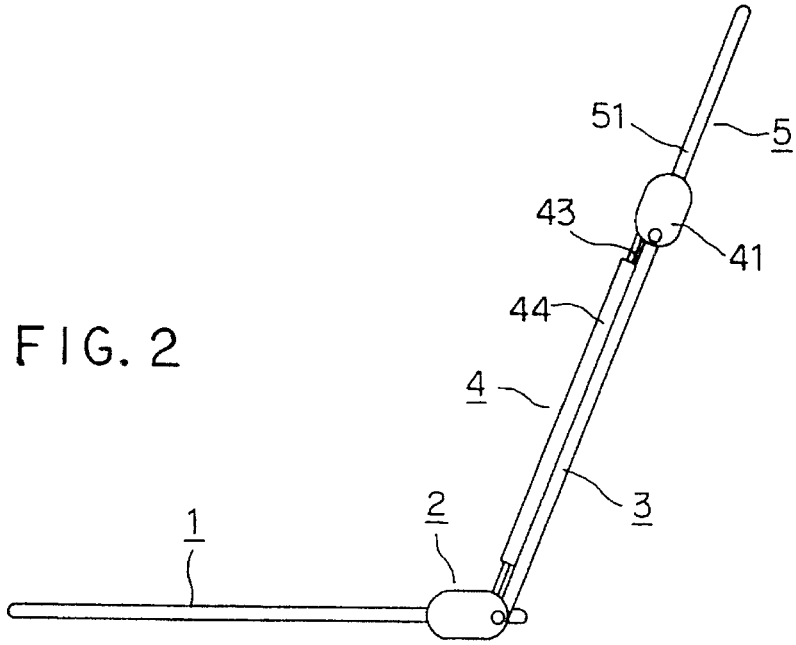
FIG. 2 is a side view showing a second embodiment of the reclining legless chair with interlocking headrest of this invention under a bending state of the back frame.
Figure 3:
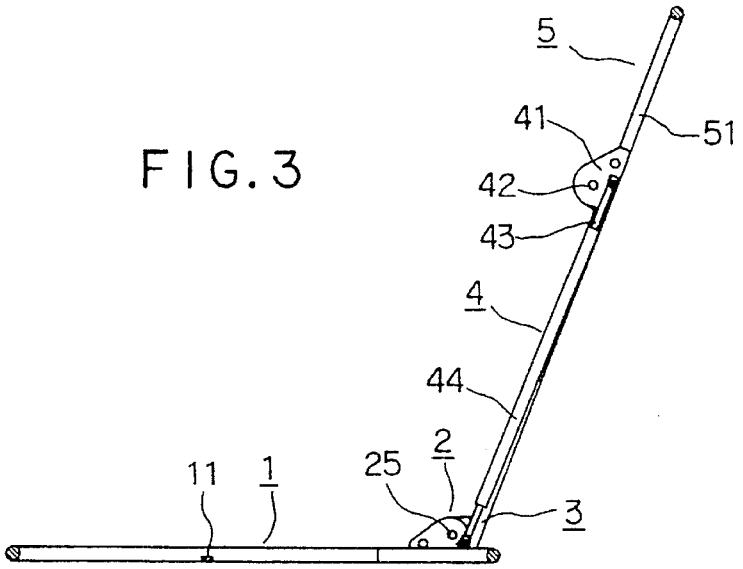
FIG. 3 is a side cross sectional view showing the first embodiment of the reclining legless chair with interlocking headrest of this invention under a bending state of the framework.
Figure 4:
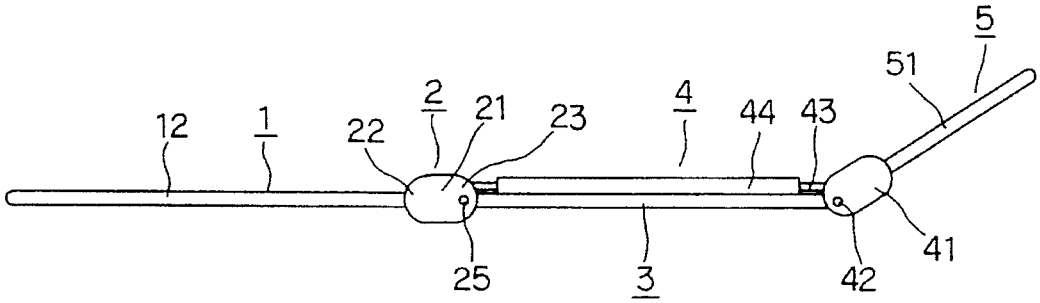
FIG. 4 is a side view showing the second embodiment of the reclining legless chair with interlocking headrest of this invention under a stretching state of the framework.
Figure 5:
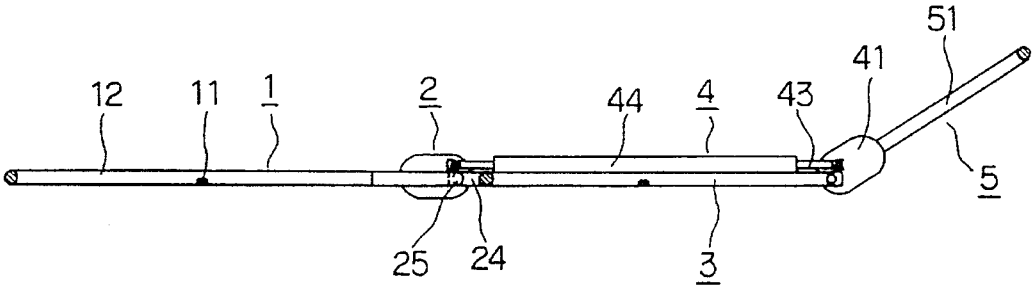
FIG. 5 is a side cross sectional view showing the second embodiment of the reclining legless chair with interlocking headrest of this invention under a stretching state of the framework.

The interlocking mechanism 4 is a device provided to make the angle of the headrest frame 5 vary, as described later, in relation to the change in the setting angle of the ratchets 2. The interlocking mechanism 4 is constructed from the hinged joint or pivot assembly 41, which connects the other end of the straight rod of the back materials 3 with one of the opening ends 51 of the headrest frame 5, and a connecting rod i.e., interlock member 43, which is installed between the inside of each of the hinged joints 41 and the inside of each of the frame materials 21 of the ratchets 2. The connecting rod 43 is disposed eccentric both to the pivot 42 of the hinged joint 41 and to the pivot 25 of the movable shaft 24 in the same side. A first mounting arrangement for the connecting rod 43 is illustrated in FIGS. 1, 3, 6 and 7 with respect to a first embodiment of the invention, and a second mounting arrangement for the connecting rod 43 is illustrated in FIGS. 2, 4 and 5 with respect to a second embodiment of the invention. With the help of the connecting rod 43, the hinged joint 41 can be interlockingly inclined at the ratchet 2 with an angle as shown in FIG. 7 by stretching it so as to keep the distance between the inside of the hinged joint 41 and the inside of the frame material 21 of the ratchet continuously constant.

Further, a supporting pipe 44 covers the connecting rod 43 so as to be equipped exteriorly free from the rod and protects the outside of the rod 43 from being limited by dragging in its movement in the elastic material covering the framework.

The shape of the hinged joint 41, is not limited to a fixed one but it may be available in any shape, i.e. egg-shaped (as illustrated in FIGS. 1, 3, 6 and 7), circular, or elliptic (as illustrated in FIGS. 2, 4 and 5). Depending upon the type of hinged joint 41, the orientation of the movable shaft 42 may vary.

The headrest frame 5 is made in a U-shape from either rod or pipe made of metal, wood, or plastics, and, as mentioned above, the hinged joint 41 in the interlocking mechanism 4 is fixed to both the opening ends of the side shafts 51 of the headrest frame 5.

The elastic material 6 is molded into a definite form from elastic raw materials like polyurethane and is suitable disposed all over the framework of the reclining legless chair, i.e. on the seat frame 1, the ratchets 2, the back frame materials 3, the interlocking mechanism, and the headrest frame 5.

The external cloth 7 is made from textile, leather, or synthetic leather and completely covers the outside of the elastic materials 6 as shown in FIG. 8–FIG. 10.

In the case of use of the reclining legless chair with interlocking headrest of this invention, users need only sit down on the chair after setting at will the angle of the back materials 3 against the seat as shown in FIG. 10. For example, when you use it at a completely stretched out position of the back of the chair as shown in FIG. 8, the headrest frame 5 may be kept substantially at an angle of 30° relative to the back materials 3 as shown in FIGS. 4–6 and when you use it at a bending position of the back shown in FIG. 9, the headrest frame 5 may be kept in a position parallel to the back materials 3 of the chair or in a bit backward position toward the back materials 3 as shown in FIG. 2 and FIG. 3. Thus, the users can use the chair comfortably and easily only by changing the angle of the back materials 3 against the seat and this handling makes the angle of the headrest frame 5 vary stepwise and concertedly as shown in FIG. 7.

As mentioned above, the reclining legless chair with interlocking headrest of this invention is constructed from a framework composed of a seat frame, back materials, and a headrest frame, in which the first two are connected to each other through ratchets and the latter two are connected to each other through interlocking mechanisms to make the angle of the headrest vary interlockingly in relation to the angle of the back against the seat. The chair is made by covering the frame with elastic materials and is finished with external cloth, and therefore, users can use it comfortably only by setting the angle of the inclination of the back against the seat which differs from the previously invented reclining legless chairs which had to be installed with more than two of the ratchet gearings. As a result, the present legless chair with the variable angle of the headrest can be made without raising the manufacturing cost largely, and further, users need not set anew the angle of the headrest against the back of the chair.

Thus, this invention has cleared away all of the previous faults and satisfies many kinds of requirements for making a reclining legless chair with interlocking headrest, and can make it possible to present such a chair so as to be cheaper and easy to handle. Therefore, the market for such a reclining chair of the invention equipped with headrest brings a great profit hitherto hardly ever seen.

We claim:

1. A reclining legless chair with interlocking headrest comprising:

a seat including a U-shaped seat frame having two spaced apart frame members extending rearwardly to define rear ends thereof;

a backrest including a backrest frame which includes two spaced apart frame side members, each said frame side member having a first end disposed adjacent to a respective one of said rearward ends of said U-shaped seat frame and a second end opposite said first end away from said seat frame, said first ends of said backrest frame pivotally connected to said rearward ends of said seat frame by respective ratchet assemblies for selective pivoting movement of said backrest frame relative to said seat frame to an inclining angle; and a headrest including a U-shaped headrest frame having two spaced apart frame members extending toward said backrest frame and including headrest ends connected to said second ends of said backrest frame by respective interlock mechanisms to interlockingly move said headrest frame relative to said backrest frame in response to said selective movement of said back frame to said inclining angle.

2. The reclining legless chair according to claim 1, wherein each said ratchet assembly defines a pivot axis about which said seat and backrest frames pivot, each said interlock mechanism comprising a pivot assembly pivotally connecting said second ends of said backrest frame to said headrest ends of said headrest frame for pivoting of said headrest frame relative to said backrest frame about a pivot axis thereof and a connection member, said connection member having a first end connected to a housing of said ratchet assembly eccentrically relative to said pivot axis thereof and a second end connected to said pivot assembly eccentrically relative to said pivot axis thereof.

3. A reclining legless chair with interlocking headrest comprising:

a seat including a seat frame having frontward and rearward ends;

a backrest including a backrest frame having a first end disposed adjacent said rearward end of said seat frame and a second end opposite said first end away from said seat frame, said first end pivotally connected to said rearward end by a ratchet assembly therebetween which defines a pivot axis for selective pivoting movement of said backrest frame relative to said seat frame to an inclining angle;

a headrest having a headrest frame which includes a pivot end connected to said second end of said backrest frame by a pivot assembly defining a pivot axis thereof for movement of said headrest frame relative to said backrest frame; and an interlock member having first and second ends for interlockingly connecting said ratchet assembly and said pivot assembly one with the other to move said headrest frame relative to said backrest frame in response to said selective movement of said backrest frame to said inclining angle, said first end being rotatably connected to said ratchet assembly away from said pivot axis thereof in an eccentric direction relative to said pivot axis, and said second end being rotatably connected to said pivot assembly eccentrically away from said pivot axis thereof in an eccentric direction relative to said pivot axis.

4. The legless chair according to claim 3, wherein said eccentric directions extend outwardly away from the respective pivot axes on a common predetermined side thereof so that as said backrest frame is pivoted in one rotational direction, the headrest frame pivots in an opposite rotational direction.

* * * * *